US005385442A

United States Patent [19]

Lehe et al.

[11] Patent Number: 5,385,442

[45] Date of Patent: Jan. 31, 1995

[54] CENTRIFUGAL PUMP WITH AN OPEN-FACED IMPELLER

[75] Inventors: Jean-Robert Lehe, Vernon; André Beaurain, Chambly; René Bosson, Vernon; Etienne Tiret, La Chapelle Reanville, all of France

[73] Assignee: Societe Europeenne de Propulsion, Suresnes, France

[21] Appl. No.: 160,419

[22] Filed: Nov. 24, 1993

[30] Foreign Application Priority Data

Nov. 30, 1992 [FR] France ..... 92 14389

[51] Int. Cl.[6] ..... F01D 3/00

[52] U.S. Cl. ..... 415/104; 415/106

[58] Field of Search ..... 415/104, 106

[56] References Cited

U.S. PATENT DOCUMENTS

| | | | |
|---|---|---|---|
| 1,020,699 | 3/1912 | Kieser | 415/106 |
| 1,488,931 | 4/1924 | Marechal | 415/106 |
| 3,664,758 | 5/1972 | Sato | 415/106 |
| 4,793,777 | 12/1978 | Hauenstein | 415/106 |
| 4,867,633 | 9/1989 | Gravelle | 415/106 |

FOREIGN PATENT DOCUMENTS

| | | |
|---|---|---|
| 0374020 | 6/1990 | European Pat. Off. . |
| 249366 | 3/1911 | Germany . |

*Primary Examiner*—John T. Kwon
*Attorney, Agent, or Firm*—Weingarten, Schurgin, Gagnebin & Hayes

[57] ABSTRACT

A centrifugal pump with an open-faced impeller for conveying a working liquid, the pump comprising at least one open-faced impeller provided with blades placed inside a casing defining a suction pipe facing the bottoms of the blades in the vicinity of a central shaft that drives the impeller and forming a part of a rotary assembly, and a delivery pipe fitted with a fixed diffuser disposed facing the peripheral ends of the blades. An active axial balancing system for the rotary assembly, which balancing system is integrated in the impeller and comprises a balancing chamber interposed between the rear face of the body of the impeller and an outer rear portion of the casing. The balancing chamber communicating with the delivery pipe via a first nozzle whose axial clearance is kept invariable in operation and which is defined by the peripheral end of the impeller itself acting as a balancing turntable, and a nozzle piece secured to the outer rear portion of the casing and interposed between the diffuser and said peripheral end of the impeller. The balancing chamber communicating directly or indirectly with the suction pipe of the pump via a second nozzle.

2 Claims, 5 Drawing Sheets

CENTRIFUGAL PUMP WITH AN OPEN-FACED IMPELLER

FIELD OF THE INVENTION

The present invention relates to a centrifugal pump with an open-faced impeller usable not only in industrial applications but also in the context of turbopumps for rocket engines.

PRIOR ART

The turbopumps of rocket engines fitted to the first stage of a launcher are high power pumps and they are characterized by flow rates that are high and by pressures that are medium or high.

In existing embodiments of such high power turbopumps, the impellers of all the centrifugal stages of the pump are provided with shrouds secured to the impellers, thereby defining high efficiency shrouded impeller pumps that benefit from a large amount of tolerance on the axial position of the impeller, but in which peripheral speed is limited by the mechanical strength of the shroud. For a given pressure rise, the use of shrouded impellers leads to an increase in the number of pump stages, and consequently significantly increases costs. Furthermore, machining shrouded wheels is relatively complex, thereby contributing to making this type of pump even more expensive.

Proposals have already been made to implement centrifugal pump stages using open-faced impellers, i.e. impellers that do not have shrouds secured to the front portions of their blades. It is easier to machine open-faced impellers, but such open-faced impellers require clearance to be left between the front portion of the blades of such an impeller and the front portion of the pump casing, which clearance gives rise to leakage and thus reduces volumetric efficiency. To keep such efficiency at an acceptable value, either the impeller is given an axial position relative to its bearings that is highly accurate, thus giving rise to high costs even supposing said accuracy is not impossible to achieve, or else considerable impeller clearance is accepted even though that is applicable only to low power pumps, i.e. pumps that are relatively insensitive to this parameter as are pumps having high specific speed, i.e. mixed-flow pumps.

The axial balancing system of centrifugal pumps, whether having open-faced impellers or shrouded impellers, may either be a passive system, e.g. using a lubricated smooth abutment or a ball bearing with oblique contact, or else an active system with an independent balancing turntable.

Both systems, and in particular the passive system, give rise to a long sequence of design dimensions, some of which are large, and also to elastic deformations that can be determined in part, only. As a result there are adjustments, disassemblies, readjustment, and reassemblies, that do not always manage to achieve the desired result.

A high power turbopump is also known that includes open-faced impellers and that is shown in FIG. 7. That pump was designed for fitting to the XLR 129 engine whose development was undertaken by the firm PRATT & WHITNEY.

In such a turbopump, the central shaft 122 driven at its rear end by a first turbine stage 132 and by a second turbine stage 133, carries at its front end an inducer 131, a first stage open-faced impeller 105 and a second stage open-faced impeller 155 mounted back-to-back in opposition on bearings 123 and 124. Each of the impellers 105 and 155 carries blades 106 and 156 that are not fitted with an outer shroud and that are thus positioned directly facing thick walls of a casing 101, 102. Axial balancing is provided by a separate balancing piston 160 which constitutes an active force regulator, the shaft 122 being free to move axially and taking up a position such that the sum of the axial forces applied thereto is zero. Because of the presence of a separate balancing piston, it is difficult to control the clearance between the open-faced impellers and the corresponding faces of the casing with Great accuracy, so losses due to fluid leakage can be large, thereby making it impossible to obtain high volumetric efficiency.

OBJECTS AND BRIEF SUMMARY OF THE INVENTION

The present invention seeks to provide an open-faced centrifugal pump for high pressure differences and large flow rates that is both simple to manufacture, making it possible to reduce the number of pump stages required for obtaining a given pressure difference since it makes very high peripheral speeds possible, and also exhibiting leakage losses that are limited so as to obtain volumetric efficiency that is Greater than for known centrifugal pumps having open-faced impellers.

The invention also seeks to provide a centrifugal pump having an open-faced impeller which is suitable for use not only in industrial applications, but also in the context of high powered turbopumps such as those which are used in a rocket engine in the first stage of a launcher.

These objects are achieved by means of a centrifugal pump with an open-faced impeller for conveying a working liquid, the pump comprising at least one open-faced impeller provided with blades placed inside a casing defining a suction pipe facing the bottoms of the blades in the vicinity of a central shaft that drives the impeller and forming a part of a rotary assembly, and a delivery pipe fitted with a fixed diffuser disposed facing the peripheral ends of the blades, the pump further including an active axial balancing system for the rotary assembly, which balancing system is integrated in the impeller and comprises a balancing chamber interposed between the rear face of the body of the impeller and an outer rear portion of the casing, said balancing chamber communicating with said delivery pipe via a first nozzle whose axial clearance is kept invariable in operation and which is defined by the peripheral end of the impeller itself acting as a balancing turntable, and a nozzle piece secured to said outer rear portion of the casing and interposed between the diffuser and said peripheral end of the impeller, said balancing chamber communicating directly or indirectly with the suction pipe of the pump via a second nozzle.

Thus, in accordance with the invention, the axial balancing system of the rotor including the open-faced impeller is of the active type and is integrated in the impeller which itself acts as the balancing piston. As a result, an accurate axial reference is available in the immediate vicinity of the tops of the impeller blades.

In accordance with the invention, the parts are so disposed that the clearance between the impeller and the casing facing it can be determined by a small number of design dimensions. Leakage losses can thus be greatly reduced in a centrifugal pump of the invention since the clearance between the front face of the case and the open-faced impeller is controlled by positioning the peripheral regions of the impeller and of the intermediate part relative to the active faces of the upper nozzle of the axial balancing system which has very accurate clearance, by making use of a sequence of design dimensions that is kept down to a minimum.

According to an important aspect of the present invention, the clearance J between the impeller and the front portion of the casing is determined by a sequence of design dimensions limited to a design dimension J1 defined between said radial nozzle piece and said front wall of the casing facing the blades, a design dimension J12 defined between said nozzle piece and the peripheral end of the impeller, and a design dimension J13 defined between said peripheral end of the impeller and the front face of the impeller.

The sequence of design dimensions is thus restricted to three design dimensions only, whereas prior art embodiments either required eight accurate design dimensions to be provided in sequence or else they required the result of the sequence of design dimensions to be adjusted specifically by providing a wedge for adjusting the thickness of the impeller on request.

The invention is particularly applicable to a high power turbopump for a rocket engine.

BRIEF DESCRIPTION OF THE DRAWINGS

Other characteristics and advantages of the invention appear from the following description of a particular embodiment of the invention, given by way of non-limiting example and made with reference to the accompanying drawings, in which.

DETAILED DESCRIPTION OF PARTICULAR EMBODIMENTS

Figure 1:
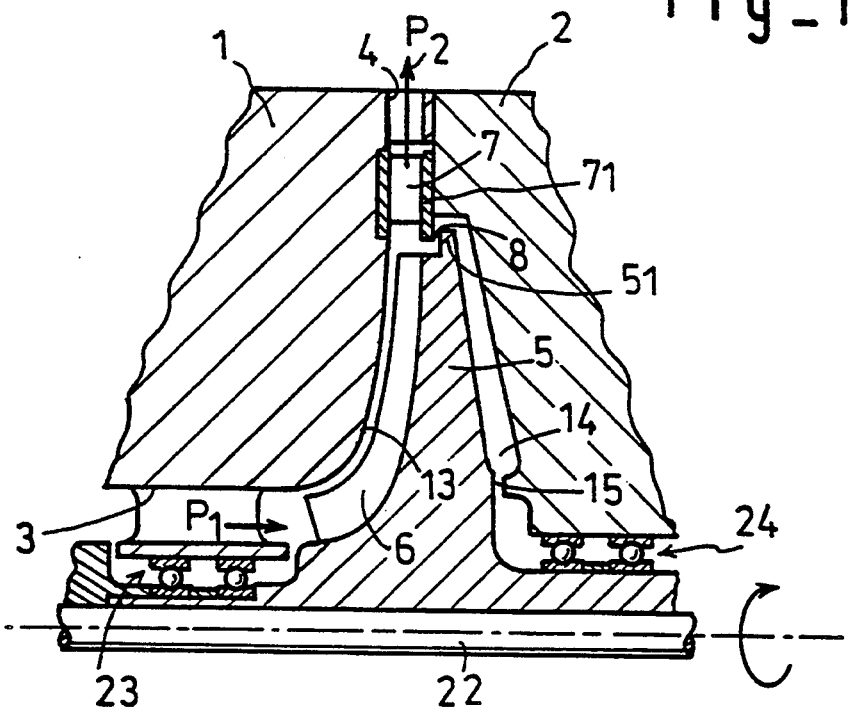
FIG. 1 is an axial half-section view showing an active axial balancing system integrated in the open-faced impeller of a centrifugal pump in accordance with the present invention.

The general structure of a centrifugal pump having an open-faced impeller in accordance with the invention is initially described with reference to FIGS. 1 and 4.

The impeller 5 comprises a body having blades 6 mounted on its front face and rotated by a central shaft 22 mounted by means of bearings 23 and 24 inside a casing 1, 2 which includes a front portion 1 and a rear portion 2. A suction pipe 3 is provided in the front portion 1 of the casing in the vicinity of the central shaft 22 to put the blades 6 of the impeller 5 in contact with a fluid at a pressure P1. A diffuser 7 mounted on the rear portion 2 of the casing and extended by a delivery pipe 4 is disposed around the peripheral portion of the blades 6 on the impeller 5 to evacuate fluid at a delivery pressure P2 greater than the suction pressure P1, said fluid being evacuated by means of a manifold in the form of a volute or a torus (not shown in FIG. 1).

In accordance with the invention, the impeller 5 is of the open-faced type, i.e. no shroud is mounted on the front face of the impeller, and an active axial balancing system for the rotary assembly makes use of the rear portion of the impeller 5 as a balancing turntable. Thus, a nozzle 8 defining clearance J12 that does not vary in operation (FIG. 4) is connected to the peripheral portion of the impeller between a piece 71 secured to the rear portion 2 of the casing, or of the diffuser 7, and a peripheral portion 51 of the body of the impeller 5 which comes into position behind the piece 71. The nozzle 8 provides communication for the fluid present at the inlet of the diffuser 7 to pass into a chamber 14 situated behind the body of the impeller 5 and opening out at its end closest to the shaft 22 via a calibrated orifice 15.

A small amount of clearance 13 of magnitude J is defined between the front portion 1 of the casing 1, 2 and the blades 6.

In general, for given specified flow rate and pressure rise, and for a given speed of rotation, it is necessary to reduce the ratio J/B of the clearance J between the impeller 5 and the wall facing the blades 6 of the impeller 5 divided by the width or depth B of the blades 6 on the impeller 5 at the periphery of the impeller, to a level that makes it possible to ensure acceptable performance.

For impellers that provide a large increase in pressure, any increase in the width B of the blades 6 at the outlet from the impeller 5 is limited, in practice, by the need to ensure adequate mechanical strength for the impeller, and the clearance J tends to increase with increasing speed of rotation, given the way the casing deforms.

Figure 8:
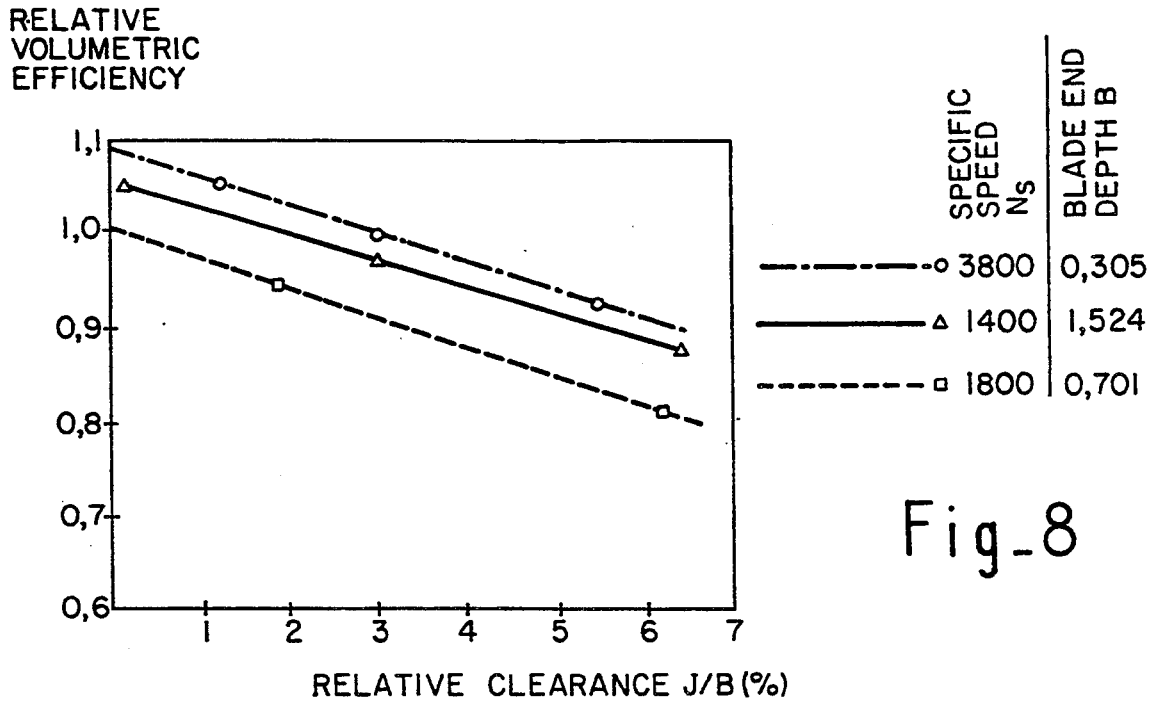
FIGS. 8 to 10 are known charts applicable to centrifugal pumps and giving, for different specific speeds, respectively the relative volumetric efficiency as a function of the relative clearance at an impeller, the relative pressure rise as a function of the clearance at the impeller, and the additional volumetric efficiency as a function of flow rate.
Figure 9:
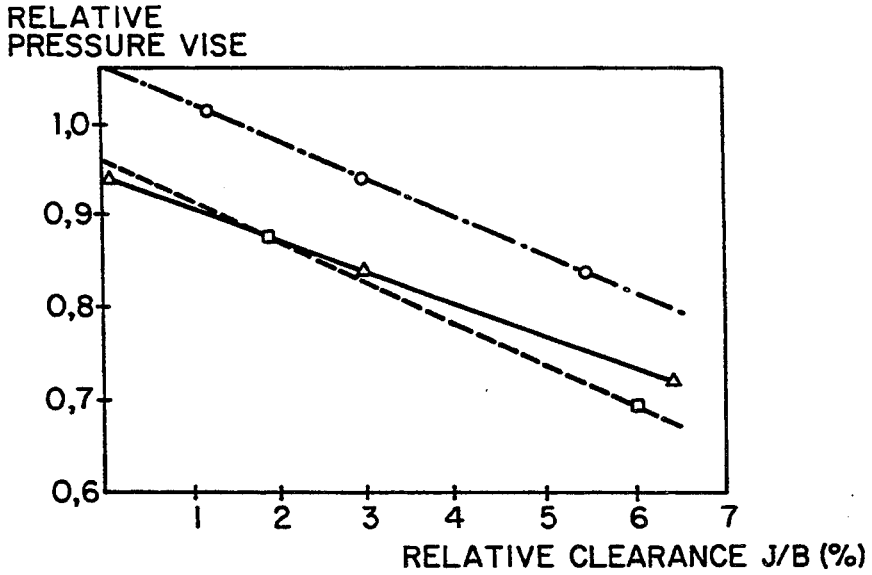
Figure 10:
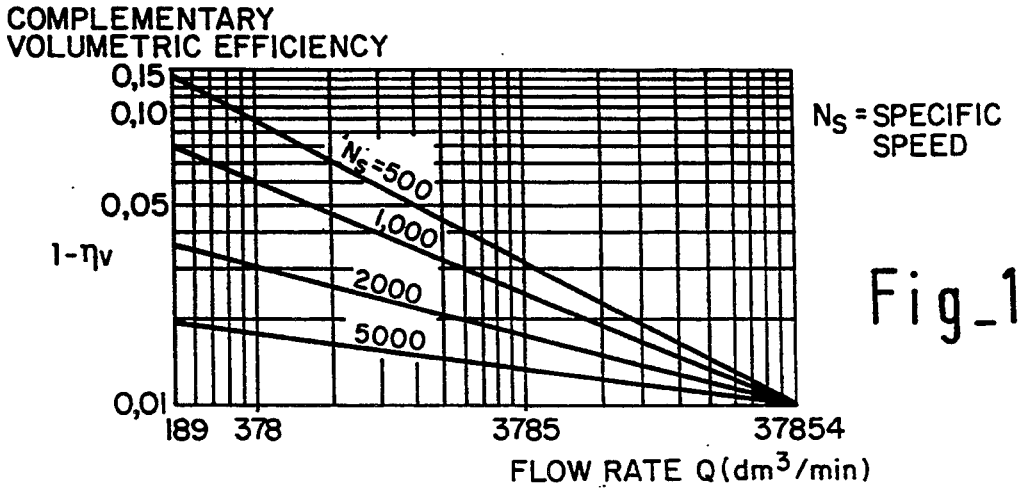

FIGS. 8 to 10 comprise three known charts applicable to a centrifugal pump and showing how the volumetric efficiency and the increase in pressure are a function of the relative clearance J/B, of the specific speed, and of the flow rate.

The charts of FIGS. 8 and 9 are taken from a monograph published by NASA and entitled "Centrifugal flow turbopump", whereas the chart of FIG. 10 is taken from the work "Pump handbook" by I. J. Karassik, W. C. Krutzch, W. H. Fraser, and J. P. Messina, published by McGraw-Hill Book Company.

The charts of FIGS. 8 and 9 relate to three different specific speeds corresponding to different depths for the ends of the impeller blades, and respectively they give the relative volumetric efficiency and the relative pressure rise of an open-faced impeller relative to a pump having a shrouded impeller, as a function of the relative clearance J/B where J is the clearance between the wall facing the blades of the impeller and the impeller itself, and B is the depth of the impeller blades at the periphery of the impeller.

For four different specific speeds $N_s$, the chart of FIG. 10 gives the complementary volumetric efficiency $(1-\eta_v)$ as a function of flow rate Q, the specific speed $N_s$ being determined from the speed of rotation N of the impeller expressed in revolutions per minute (rpm), the flow rate Q expressed in liters per minute, and the depth B of the blades expressed in cm, by the equation:

$$N_s=(0.514\ N\sqrt{Q})/(0.077\ B^{3/4})$$

It may be observed that the relationship between the expressions for the specific speed $N_s$ appearing in the charts of FIGS. 8 and 10 and the non-dimensional specific speed appearing in the comparative table given below is as follows:

$N_s$=(non-dimensional specific speed)/2733

By way of example, the following table also specifies performance values firstly for a pump built in conventional manner and secondly for a pump built in accordance with the invention, using typical values for pressure $P_0$=250 bar and for flow rate $Q_0$=50 kg/s.

The following table makes it possible to observe the improvement achieved by the invention in the relative clearance value J/B, and also in efficiency.

| Performance criterion | Pump satisfying ($P_0$, $Q_0$) Prior art | The invention |
|---|---|---|
| Relative clearance J/B | <6% | <2% |
| Specific speed | 0.25(1) | 0.25(1) |
| Pressure rise | $P_0$ = 250 bar | $P_0$ = 250 bar |
| Flow rate | $Q_0$ = 50 kg/s | $Q_0$ = 50 kg/s |
| Efficiency | 0.66 | 0.74 |

(1)Dimensionless number.

Figure 3:
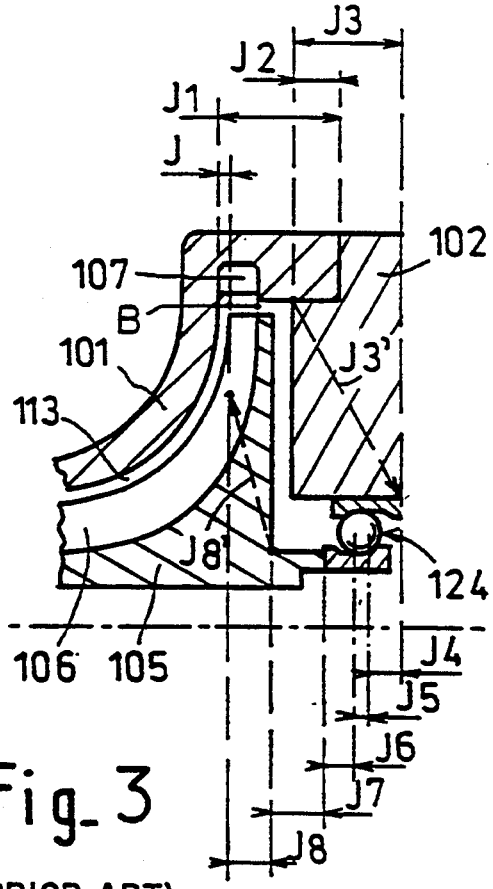
Fig 3 (PRIOR ART)
FIG. 3 is an axial half-section showing the open-faced impeller mounted in conventional manner with various different design dimensions being indicated that contribute to defining the axial clearance of the impeller.

With more particular reference now to FIGS. 3 to 6, it can be seen that in a conventional pump having an open-faced impeller as shown in FIG. 3, where the open-faced impeller 105 having blades 106 is placed directly facing the front portion 101 of the casing 101, 102, and where axial forces are taken up by a ball bearing 124 interposed between the rear portion 102 of the casing 101, 102 and the shaft of the impeller 105, the clearance J between the blades 106 of the impeller 105 and the front portion 101 of the casing 101, 102 is determined by a vector sequence of eight designed dimensions J1 to J8 of narrow tolerance as specified in FIG. 3.

Figure 5:
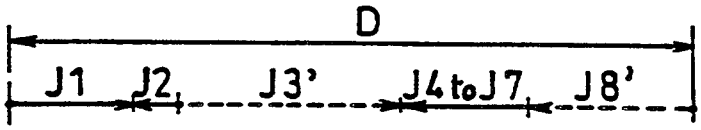
FIGS. 5 and 6 are comparative diagrams showing the accumulated distances of the design dimensions that contribute to defining clearance in the conventional assembly of FIG. 3 and in the assembly of the invention of FIG. 4.

FIG. 5 shows the sum D of the moduluses of the various vectors J1 to J8 corresponding to the different design dimensions that contribute to defining the clearance J in the known embodiment of FIG. 3 which does not enable an integrated axial balancing system to be implemented in the impeller. The clearance J is poorly controlled given that the number of design dimensions and thus of interfaces is large and given that the distance D is large. The tolerances on design dimensions J1 to J6 and on dimension J8 can be considerably improved by using an adjusting wedge that corresponds to dimension J8. However that merely replaces one difficulty with a different difficulty.

Figure 4:
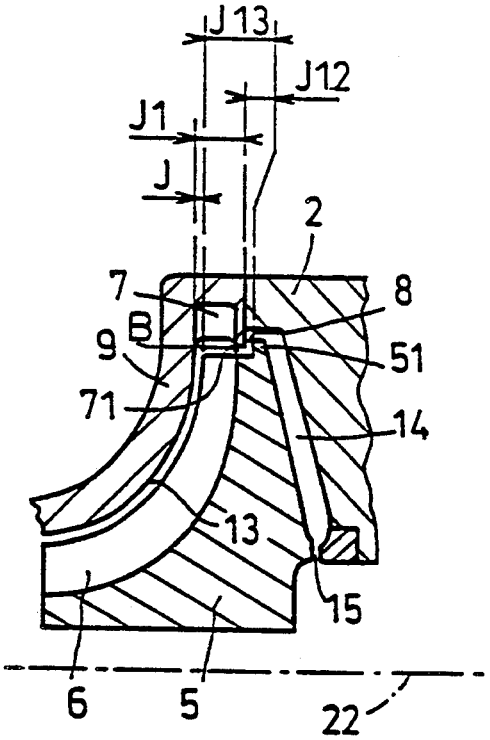
FIG. 4 is an axial half-section of an open-faced impeller mounted in accordance with the invention, and indicating the various design dimensions that contribute to defining the axial clearance of the impeller.
Figure 6:
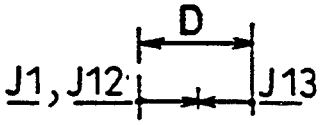
Figure 7:
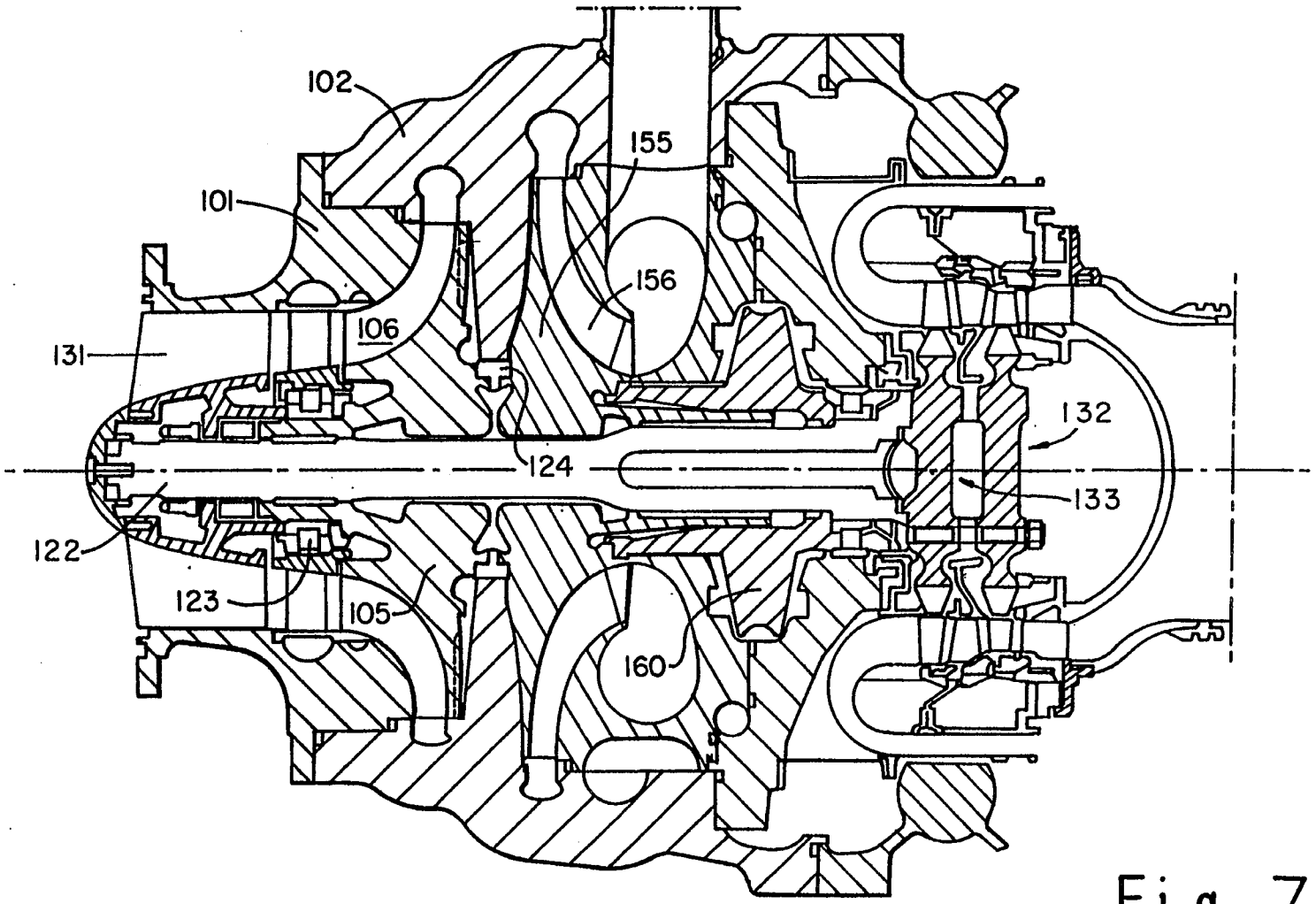
Fig 7 (PRIOR ART)
FIG. 7 is an axial section view through a prior art turbopump project implementing two open-faced impellers mounted back-to-back.

In contrast, FIG. 6 shows that in the context of the present invention, as shown in FIG. 4, the clearance J between the impeller 5 and the intermediate piece 9 is determined by a small number of design dimensions: J1, J12, and J13. Dimension J1 is defined between the radial projection 71 secured to the diffuser 7 and the wall of the intermediate piece 9 facing the blades 6. The dimension J1 thus has a position that depends on pressure to a small extent. The dimension J12 is defined between the radial projection 71 secured to the diffuser 71 and the shoulder 51 implemented at the periphery of the impeller 5 and thus constitutes clearance that does not vary in operation. The dimension J13 is defined between the shoulder 51 of the impeller 5 and the front face of the impeller 5. As can be seen in FIG. 6, the accumulated distance D between the reference points of the vectors J1, J12, and J13 in three dimensions is greatly reduced, and the clearance J can be defined with maximum accuracy because of the existence of an accurate axial reference in the immediate vicinity of the tops of the blades 6 of the impeller 5 at the nozzle 8.

Figure 2:
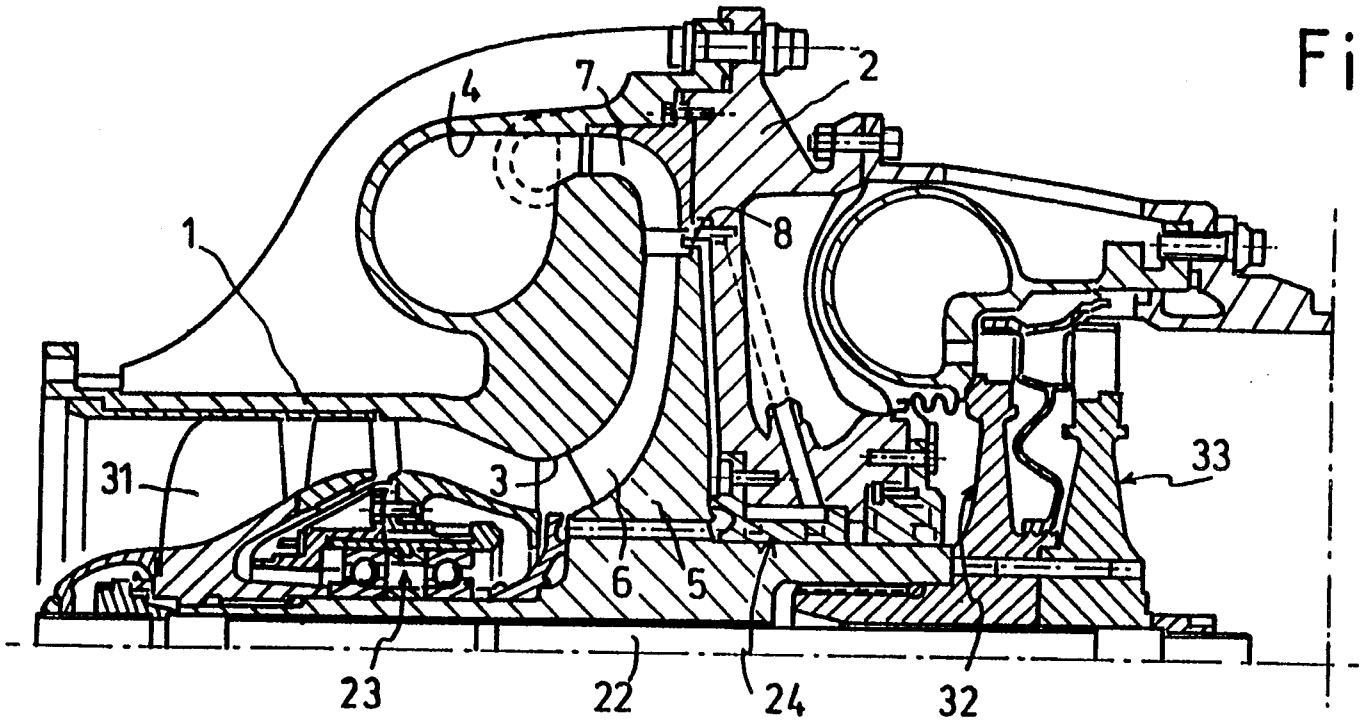
FIG. 2 is an axial half-section view showing the general structure of a centrifugal pump having an open-faced impeller in accordance with the invention, and including the active axial balancing system of FIG. 1.

By way of example, FIG. 2 shows a turbopump including two turbine stages 32 and 33, an inducer 31, and two bearings 23 and 24 supporting the shaft 22 of an open-faced impeller 5 which integrates an active axial balancing system of the invention.

The invention is applicable to centrifugal pumps suitable for use over a very wide range of conditions.

By way of example, the invention may be implemented in a single stage turbopump having a delivery pressure of 250 bar, a flow rate of 100 kg/s, an axial thrust of 100 metric tons, and a peripheral speed of the impeller equal to 640 meters per second (m/s).

We claim:

1. A centrifugal pump with an open-faced impeller for conveying a working liquid, the pump comprising at least one open-faced impeller provided with blades placed inside a casing defining a suction pipe facing bottoms of the blades in the vicinity of a central shaft that drives the at least one open-faced impeller and forming a part of a rotary assembly, and a delivery pipe fitted with a fixed diffuser disposed facing peripheral ends of the blades, the pump further including an active axial balancing system for the rotary assembly, which balancing system is integrated in the at least one open-faced impeller and comprises a balancing chamber interposed between a rear face of the body of the at least one open-faced impeller and an outer rear portion of the casing, said balancing chamber communicating with said delivery pipe via a first nozzle whose axial clearance is kept invariable in operation and which is defined by a peripheral end of the at least one open-faced impeller acting as a balancing turntable, and a nozzle piece secured to said outer rear portion of the casing and interposed between the fixed diffuser and said peripheral end of the at least one open-faced impeller, said balancing chamber communicating with the suction pipe of the pump via a second nozzle;

said centrifugal pump having a clearance J between the at least one open-faced impeller and a front portion of the casing which is determined by a sequence of design dimensions limited to a design dimension J1 defined between said radial nozzle piece and said front wall of the casing facing the blades, a design dimension J12 defined between said nozzle piece and the peripheral end of the at least one open-faced impeller and a design dimension J13 defined between said peripheral end of the at least one open-faced impeller and a front face of the at least one open-faced impeller.

2. A centrifugal pump according to claim 1, wherein said pump is used as a high powered turbopump for a rocket engine.

* * * * *